US009631379B2

(12) United States Patent
Koot

(10) Patent No.: US 9,631,379 B2
(45) Date of Patent: Apr. 25, 2017

(54) BUILDING CONSTRUCTION METHOD AND LIFTING DEVICE

(71) Applicant: Neil Joseph Koot, Levin (NZ)

(72) Inventor: Neil Joseph Koot, Levin (NZ)

( * ) Notice: Subject to any disclaimer, the term of this patent is extended or adjusted under 35 U.S.C. 154(b) by 0 days.

(21) Appl. No.: 14/515,309

(22) Filed: Oct. 15, 2014

(65) Prior Publication Data

US 2015/0101279 A1 Apr. 16, 2015

(30) Foreign Application Priority Data

Oct. 16, 2013 (NZ) ..... 616756

(51) Int. Cl.

| | |
|---|---|
| ***B66F 3/25*** | (2006.01) |
| ***E04G 21/14*** | (2006.01) |
| ***E04B 1/35*** | (2006.01) |
| ***E04G 21/16*** | (2006.01) |
| *B66F 7/06* | (2006.01) |

(52) U.S. Cl.

CPC ..... *E04G 21/163* (2013.01); *E04B 1/3527* (2013.01); *B66F 3/25* (2013.01); *B66F 7/06* (2013.01); *E04B 1/35* (2013.01); *E04B 1/3511* (2013.01); *E04B 2001/3588* (2013.01)

(58) Field of Classification Search

CPC ..... E04G 21/167; E04G 21/14; B66F 1/00; B66F 3/25; B66F 7/00; B66F 7/06; B66F 7/0616; B66F 2700/05; B66F 9/00

USPC ..... 52/122.1, 125.2, 125.6, 745.2, 745.02; 414/11, 12; 187/239, 203

See application file for complete search history.

(56) References Cited

U.S. PATENT DOCUMENTS

| | | | | |
|---|---|---|---|---|
| 3,252,688 | A * | 5/1966 | Wiggins | 254/89 R |
| 3,679,177 | A | 7/1972 | Scholz | |
| 3,759,349 | A * | 9/1973 | Sieffert | 52/745.2 |
| 3,877,582 | A * | 4/1975 | Moore | 414/11 |
| 4,058,952 | A * | 11/1977 | Donnelly | E04B 1/34357 52/125.1 |
| 4,110,952 | A * | 9/1978 | Blachura | 52/745.02 |
| 4,482,130 | A * | 11/1984 | Paredes | 254/8 R |
| 4,601,141 | A * | 7/1986 | Donnelly | E04B 1/3527 254/89 H |
| 4,634,319 | A * | 1/1987 | May | E04G 23/06 405/230 |

(Continued)

FOREIGN PATENT DOCUMENTS

| | | |
|---|---|---|
| NL | 1024191 | 3/2005 |
| WO | WO2007/068064 | 6/2007 |

*Primary Examiner* — Phi A

(74) *Attorney, Agent, or Firm* — Foley & Lardner LLP; Christopher C. Bolten; Albert K. Heng

(57) ABSTRACT

A lifting device for lifting an upper portion of a building which comprises a roof and a method of constructing a building using such a lifting device. The lifting device includes a base plate arranged to be mounted to an edge region of a support and a lifting platform attached to an actuator and capable of vertical movement by means of the actuator. The base plate has a first portion arranged to abut a substantially horizontal face of the support and a second portion arranged to abut a substantially vertical face of the support. The actuator is adjustably mounted to the base plate such that the position of the actuator is horizontally and/or vertically adjustable relative to the base plate to ensure a plumb lift.

22 Claims, 10 Drawing Sheets

(56) References Cited

U.S. PATENT DOCUMENTS

| | | | | |
|---|---|---|---|---|
| 4,673,315 | A * | 6/1987 | Shaw | E02D 35/00 405/229 |
| 4,749,061 | A * | 6/1988 | Orndorff et al. | 187/401 |
| 4,955,174 | A | 9/1990 | Valente | |
| 5,088,263 | A * | 2/1992 | Horii et al. | 52/745.13 |
| 5,246,311 | A * | 9/1993 | West | E02D 35/00 405/229 |
| 5,645,395 | A | 7/1997 | Huang | |
| 5,711,110 | A * | 1/1998 | Williams | E01F 13/085 49/25 |
| 5,951,206 | A * | 9/1999 | Gregory | E02D 35/00 405/229 |
| 6,142,710 | A * | 11/2000 | Holland, Jr. | E02D 33/00 405/229 |
| 6,193,442 | B1 * | 2/2001 | May | E02D 35/00 405/232 |
| 6,250,655 | B1 * | 6/2001 | Sheeks | 280/79.7 |
| 6,260,311 | B1 * | 7/2001 | Vladikovic | 52/122.1 |
| 6,511,275 | B2 * | 1/2003 | Ray | 414/11 |
| 6,681,544 | B2 * | 1/2004 | Wall | 52/745.2 |
| 7,387,293 | B2 * | 6/2008 | Boucher | 254/131 |
| 7,661,512 | B2 * | 2/2010 | Feldmiller, Jr. | B66F 1/00 182/133 |
| 8,590,266 | B2 * | 11/2013 | Young | 52/745.2 |
| 8,701,827 | B2 * | 4/2014 | Taylor | 182/82 |
| 8,998,159 | B2 * | 4/2015 | Pearson | E04G 25/06 248/354.1 |
| 2002/0159863 | A1 * | 10/2002 | Ray | 414/11 |
| 2009/0241448 | A1 * | 10/2009 | Lilien et al. | 52/294 |
| 2015/0101279 | A1 * | 4/2015 | Koot | 52/745.02 |

* cited by examiner

BUILDING CONSTRUCTION METHOD AND LIFTING DEVICE

CROSS-REFERENCE TO RELATED APPLICATION

This application claims priority to New Zealand Patent Application No. 616756, filed Oct. 16, 2013, the entire contents of which are incorporated herein by reference.

TECHNICAL FIELD

This invention relates to a method of constructing a building and a lifting device suitable for use in performing the method.

As used throughout the specification, the term "building" is intended to refer to any fixed structure of one or more storeys forming an enclosure with a roof, including but not limited to, a house, school, factory or stable.

BACKGROUND OF THE INVENTION

A typical method of constructing a building begins with the following four steps in this order: (i) excavate the building site and lay the foundations; (ii) pour concrete floors; III construct the framing; and (iv) put the roof on.

It is desirable to have the roof constructed as quickly as possible to ensure the building is weathertight and further construction work can be undertaken inside the building. However, the distance between the ground and the roof of even a one-storey building is such that it is a legal requirement in many countries to put up scaffolding and/or other fall prevention mechanisms to ensure the safety of workers constructing the roof.

Scaffolding can be expensive and the time taken to install it can delay the construction of the roof. Additionally, the roofing materials used in the construction of the roof need to be lifted from the ground to the workers on the scaffolding, for example, by hand or via a pulley. This can also delay the construction of the roof.

U.S. Pat. No. 4,955,174 describes a building construction method in which a roof is constructed on the ground before being lifted by crane onto the top of a building frame and connected to the frame. Although this removes the need for scaffolding, a crane requires an experienced operator and sufficient room to swing the crane and room on site to build the roof. Accordingly, a crane can be expensive to operate and is not always suitable.

It is an object of the invention to provide a method of constructing a building and a lifting device for use in performing the method which will overcome the abovementioned difficulties or disadvantages.

BRIEF SUMMARY OF INVENTION

According to a first aspect of the invention, there is provided a method of constructing a building comprising the steps of preparing a floor surface, constructing an upper portion of a building which comprises a roof, lifting the upper portion of the building to an elevated position above the floor surface so as to create a space between the floor surface and the underside of the upper portion of the building, and supporting the upper portion of the building in the elevated position for further construction work.

The upper portion of the building is preferably constructed on a plurality of spaced apart spacer elements on the floor surface and lifted from an initial position on the spacer elements to the elevated position.

The method may include the steps of fixing a bottom plate around the perimeter of the floor surface and fixing a top plate around the underside of the upper portion of the building.

The upper portion of the building may be lifted to the elevated position by one or more lifting devices. The or each lifting device may be mounted to the floor surface. In an embodiment involving a plurality of lifting devices, each device may be spaced apart around an edge along the perimeter of the floor surface and mounted to the edge by the base plate.

The upper portion of the building may be supported during the lift, and in the elevated position, by one or more support means in such a manner that the upper portion cannot fall to the floor surface in the event of the failure or removal of the or each lifting device. The lifting device itself may have a safety mechanism to prevent the upper portion of the built from falling to the floor surface.

The upper portion of the building may be lifted to a first elevated position by one or more lifting devices and supported in the first elevated position by one or more support means. If necessary for further elevation, the or each lifting device may then be fitted with an extension portion capable of lifting the upper portion of the building to a second elevated position which is higher than the first elevated position. The or each lifting device may lift the upper portion of the building from the first elevated position to the second elevated position.

The upper portion of the building may consist of a roof or, alternatively, a roof and one or more storeys of the building.

The further construction work may comprise constructing or inserting a lower portion of the building within the space between the floor surface and the underside of the upper portion of the building. The lower portion of the building may comprise one or more storeys of the building.

According to a second aspect of the invention, there is provided a lifting device for lifting an upper portion of a building which comprises a roof, the device comprising a base plate arranged to be mounted to an edge region of a support and a lifting platform attached to an actuator and capable of vertical movement by means of the actuator, wherein the base portion has a first portion arranged to abut a substantially horizontal face of the support and a second portion arranged to abut a substantially vertical face of the support, and the actuator is adjustably mounted to the base plate such that the position of the actuator is horizontally and/or vertically adjustable relative to the base plate to ensure a plumb lift.

The support may comprise a floor surface having an upper face and a plurality of side faces extending between the upper face and a lower surface, such as, a ground surface. The support may further comprise a bottom plate fixed to the upper face of the floor surface. The actuator may be fixed to a vertically adjustable plate which is adjustably mounted to the lower horizontal portion of the base plate such that the actuator is vertically adjustable relative to the base plate to ensure a plumb lift.

In one embodiment, the base plate has a generally Z-shaped cross-sectional configuration comprising an upper horizontal portion, a vertical middle portion and a lower horizontal portion. The upper horizontal portion may have a downwardly extending lip.

In another embodiment, the base plate has a generally T-shaped cross-sectional configuration comprising two horizontal portions and an intersecting vertical portion.

The actuator may be slidably mounted to the base plate by virtue of a linear-motion slide assembly comprising a pair of spaced apart runners connected to either the base plate or to a vertically adjustable plate attached to the base plate.

The lifting device may include a support means for supporting an upper portion of a building in an elevated position, the support means being arranged in such a manner that the upper portion cannot fall to a floor surface in the event of the failure of the lifting device.

The support means may comprise a load receiving platform capable of vertical movement, an extendable prop comprising two or more elongate elements capable of telescoping relative to each other, and one or more locking mechanisms to prevent retraction of an elongate element. The extendable prop may be adjustably mounted to the base plate such that the position of the prop is horizontally and/or vertically adjustable relative to the base plate.

The actuator may be a hydraulic actuator, such as, a hydraulic jack or hydraulic ram. In one embodiment, the actuator is a hydraulic jack.

BRIEF DESCRIPTION OF THE DRAWINGS

Embodiments of the method of constructing a building and the lifting device will now be described, by way of example only, with reference to the accompanying drawings in which.

DETAILED DESCRIPTION OF THE INVENTION

Figure 1:
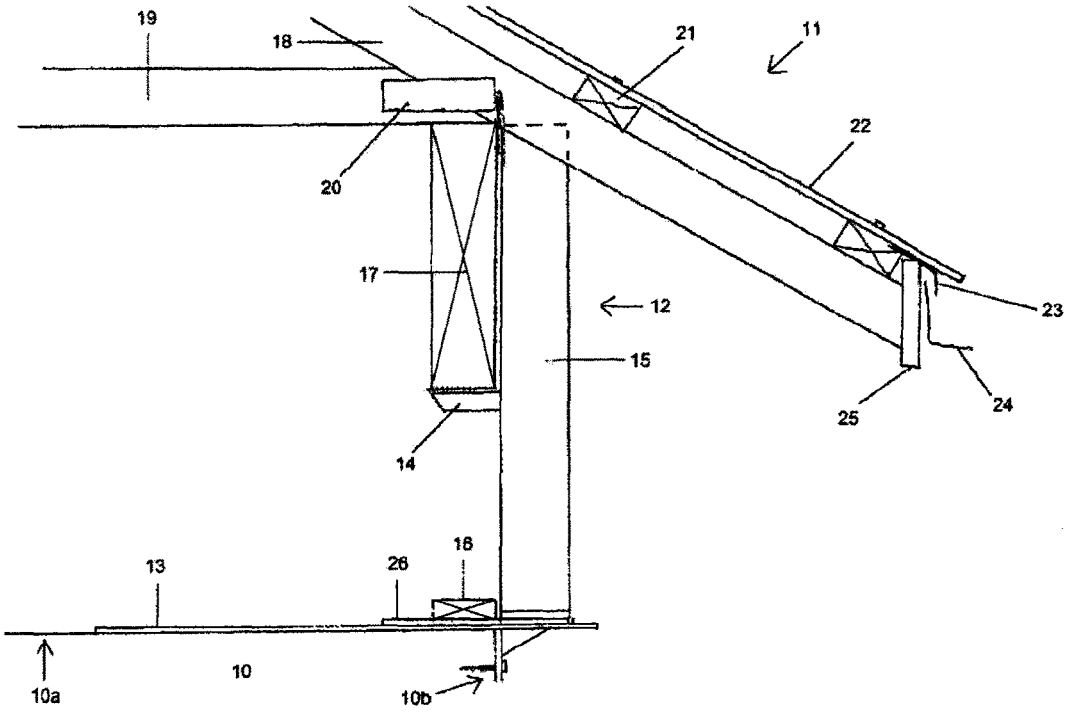
FIG. 1 is a side view of a first embodiment of a lifting device, in use, lifting a roof.

With reference to the drawings, the invention relates to a method of constructing a building comprising the steps of preparing a floor surface 10, constructing an upper portion of a building which comprises a roof 11, lifting the upper portion of the building to an elevated position above the floor surface so as to create a space between the floor surface and the underside of the upper portion of the building, and supporting the upper portion of the building in the elevated position for further construction work.

The invention also relates to a lifting device 12 for use in lifting an upper portion of a building which comprises a roof 11, the device comprising a base plate 13 and a lifting platform 14 attached to an actuator and capable of vertical movement by means of the actuator, wherein the actuator is adjustably mounted to the base plate such that the position of the actuator is horizontally and/or vertically adjustable relative to the base plate. In the embodiments described herein, the actuator is a jack 15. However, the actuator need not be a jack and could be any other type of suitable actuator, for example, a hydraulic rain.

The first step of the construction method is to prepare the floor surface 10, which may be made of any suitable material, such as, concrete, timber or earth. In the embodiments described herein, the floor surface is a poured concrete slab. The floor surface has an upper face 10*a* and a plurality of side faces 10*b* extending between the upper face and a lower surface, such as, a ground surface.

A bottom plate 16 which will serve as a locating means for the exterior and interior frames of the building is fixed to the upper face 10*a* of the floor surface 10 (the bottom plate could be left out in doorways but is preferably cut out later). The bottom plate may be made of any suitable material, such as, timber or steel. In the embodiments described herein, the bottom plate is made of timber.

A top plate 17 for the roof 11 is positioned above the bottom plate 16 and separated from the top plate by a plurality of spaced apart spacer elements (not shown). Each spacer element may be a cinder block of approximately 400 mm in height. Once the roof is constructed, the spacer elements will allow the lifting platform 14 of each lifting device 12 to be inserted into a space between the bottom plate and the top plate.

As shown in FIG. 1, in the constructed roof 11, the top plate 17 will extend downwardly from the underside of the roof. It will also extend completely around the underside of the roof so as to correspond with the exterior bottom plate 16. The top plate may be made of laminated veneer lumber (LVL) or any other suitably strong material. The depth of the top plate shown in FIG. 1 may be approximately 400 cm and the width may be approximately 90 cm. However, it will be appreciated that the top plate may have many other possible dimensions.

The roof 11 is constructed above the top plate 17. Because the roof is constructed relatively close to the floor surface 10 this method of construction is much safer for workers and there is no need for scaffolding and safety netting to be installed. This also provides a significant saving in time and money. Additionally, the building is made weathertight much more quickly than the traditional method of construction in which the roof is constructed only after the building frame has been erected.

The roof 11 may be a pitched or flat roof. In the embodiments shown in the drawings, the roof is a pitched roof comprising a plurality of roof trusses having top chords 18 and bottom chords 19 connected by gusset plates 20. The roof trusses and framing may be made of timber or steel. In the embodiments described herein, the roof trusses and framing are made of timber and the constructed building complies with the New Zealand building code (NZS 3604) for timber-framed buildings, although the method of construction is different from known methods. The purlins 21 are spaced-apart by a maximum distance of 450 mm fall protection.

To keep the top plate 17 straight, the trusses are nailed to one side of the top plate and a diagonal brace (not shown) is placed on the other side. Roofing material 22, such as corrugated iron roofing sheets or tiles, is fixed to the purlins 21. Flashings 23 and rain gutters 24 may then be added.

Plumbing and other roof penetrations, such as, fire flues and vents, are fitted along with any solar panels (not shown). These are easily locatable because all of the bottom plates 16 are already fixed in place. Gable end framing and cladding, including fascia boards 25, are also fixed into position.

A first method of lifting the roof 11 will now be described with reference to FIGS. 1 to 5. As shown in FIG. 1, the first embodiment of the lifting device 12 contains a jack 15 which will fit within the space between the upper face 10*a* of the floor surface 10 and the roofing material 22 of the constructed roof 11. A longer jack can be used either in the second embodiment of the lifting device 12 shown in FIG. 6 or in the third embodiment of the lifting device 12 shown in FIGS. 13 and 14, both of which are described below in the second method of lifting the roof.

With reference to FIG. 1, the jack 15 has a lifting platform 14 which is capable of vertical movement and may be made of steel or any other suitable metal or alloy. The jack is preferably a hydraulic jack or hydraulic ram with built-in levelling to assist in achieving a level and plumb lift of the top plate 17 and the connected roof 11 by means of the platform.

The lifting device 12 also has a base plate 13 which, as shown in FIG. 1, has a generally T-shaped cross-sectional configuration with two horizontal arms and an intersecting vertical arm. The base plate may be made of steel or any other suitable metal or alloy. A recess is cut into the bottom plate 16 to allow one of the horizontal arms of the base plate to pass through the recess in the bottom plate to the position shown in FIG. 1 in which the base plate abuts both the upper face 10*a* and a side face 10*b* of the floor surface 10. The base plate is then bolted to the upper face and, if necessary, the side face.

Figure 2:
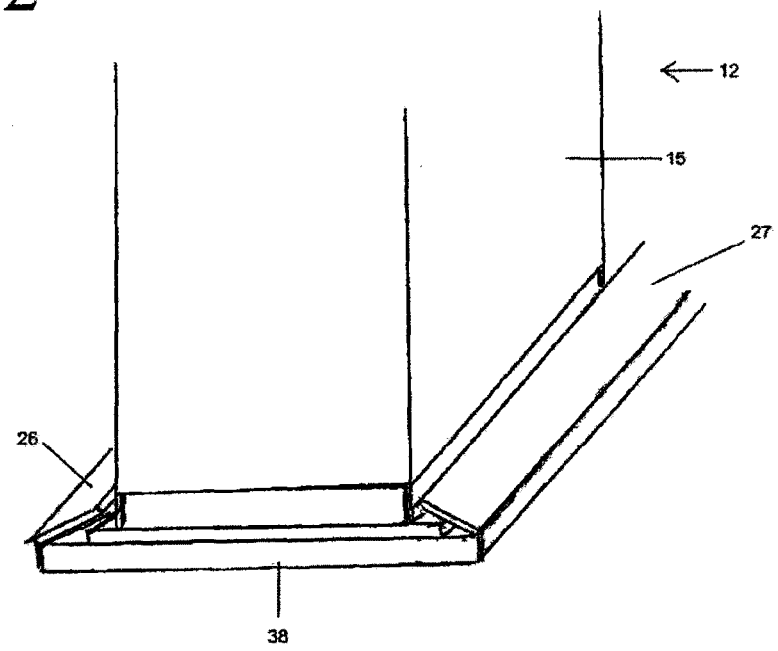
FIG. 2 is a close-up, perspective view of the base of the first embodiment of the lifting device.

As shown in FIG. 2, the jack 15 is slidably mounted to an adjustable plate 38 by virtue of a linear-motion slide assembly comprising a pair of spaced apart metal runners 26 and 27 connected to the adjustable plate. The two runners are inclined towards each other so as to slidably engage with the jack and allow the jack to move between the runners. The jack can be slidably mounted from either the front or side because the adjustable plate can be rotated by 90°. The jack and the prop can be interchangeable on the adjustable plate because they both have the same base.

A plurality of lifting devices 12 is preferably used to lift the roof 11, each device being spaced apart around the perimeter of the floor surface 10. The first stage of the lift is for the lifting platform 14 of each lifting device to lift the top plate 17, and consequently the connected roof 11, to the top of the jacks 15.

During the lift, the roof 11 is supported by a plurality of support means 28, each support means being spaced apart around the perimeter of the floor surface 10. In the event that the jacks 15 fail or are removed, the support means will prevent the roof from falling to the floor surface.

Figure 4:
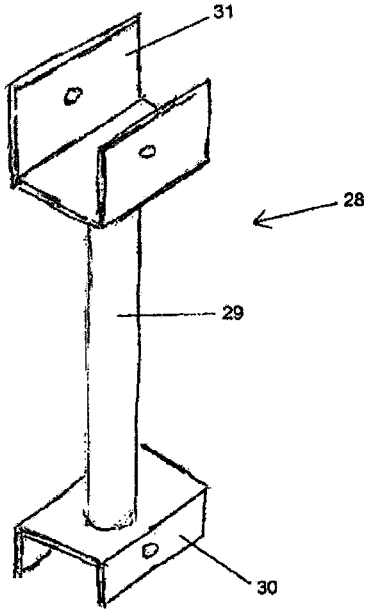
FIG. 4 is a perspective view of a first embodiment of a support means.
Figure 5:
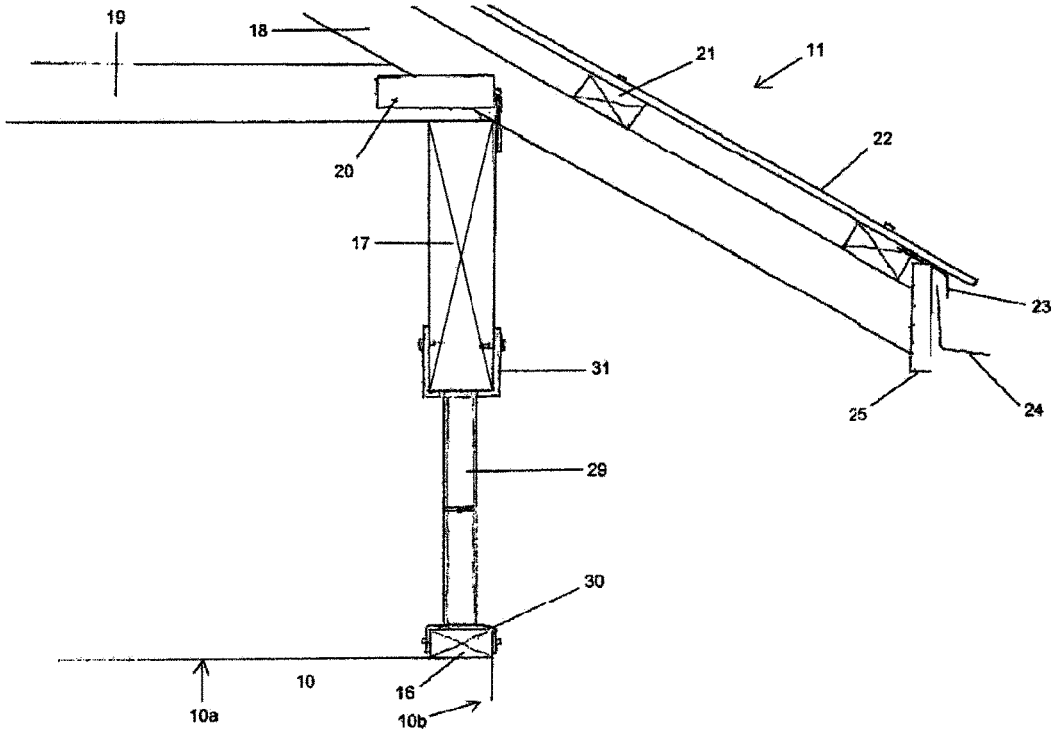
FIG. 5 is a side view of the first embodiment of the support means, in use, supporting a roof.

FIG. 4 shows a first embodiment of a support means 28 comprising an elongate shaft 29 formed from two overlapping portions which can be locked together, each portion having a generally U-shaped channel 30 and 31 connected to a free end of the portion. The shaft and the two channels may be made of steel or any other suitable metal or alloy. As shown in FIG. 5, the first channel 30 is bolted to the bottom plate 16 and the second channel 31 is bolted to the top plate 17. As the roof 11 is lifted, the two portions of the shaft can be repeatedly unlocked, repositioned relative to each other so as to extend the shaft and then locked back together.

Figure 3:
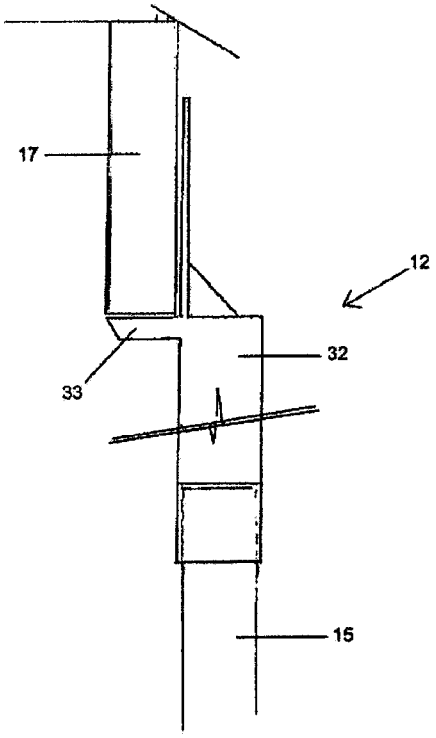
FIG. 3 is a side view of an extension portion mounted on the top of the first embodiment of the lifting device.

With the lifted roof 11 supported in a first elevated position by the support devices 28, each jack 15 can be slid along its base plate 13 to a position directly underneath the top plate 17. If necessary for further elevation, as shown in FIG. 3, an extension portion 32 with a second lifting platform 33 can then be fitted to the top of each jack. The extension portions allow the jacks to lift the roof to a second elevated position which is higher than the first elevated position. Further extension portions can be added to the jack as is necessary to get the roof to the desired height above the floor surface 10.

A second method of lifting the roof 11 will now be described with reference to FIGS. 6 to 14. The second method differs in a number of respects from the first method described above.

Figure 6:
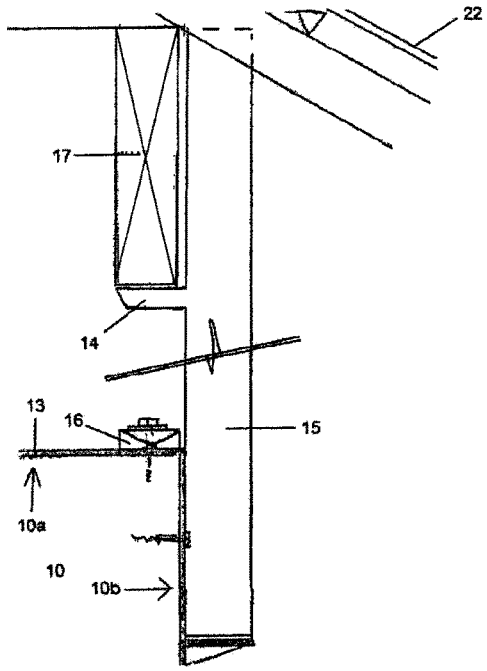
FIG. 6 is a side view of a second embodiment of a lifting device, in use, lifting a roof.
Figure 7:
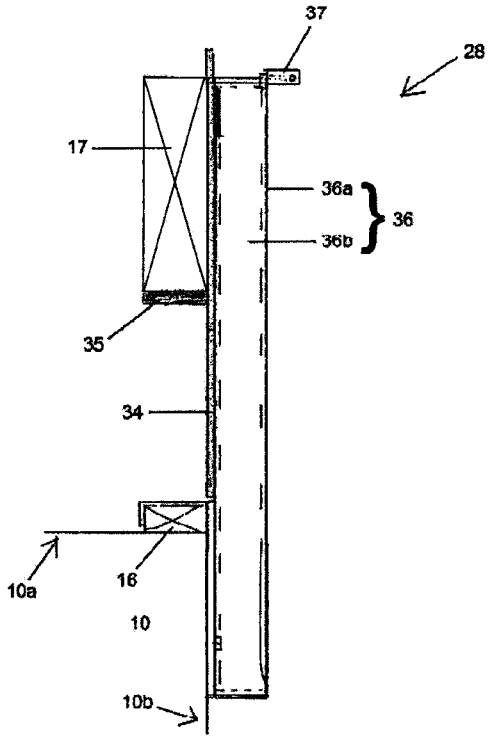
FIG. 7 is a side view of a second embodiment of a support means.

To allow a longer jack 15 to be positioned underneath the constructed roof 11, the lifting device 12 has a base plate 13 which, as shown in FIG. 6, has a generally Z-shaped cross-sectional configuration with an upper horizontal arm, a vertical middle portion and a lower horizontal arm. A recess is cut into the bottom plate 16 to allow the upper horizontal arm of the base plate to pass through the recess in the bottom plate to the position shown in FIG. 6 in which the base plate abuts both the upper face 10*a* and a side face 10*b* of the floor surface 10. The base plate is then bolted to the upper face and, if necessary, the side face. If necessary, a metal reinforcing plate can be bolted over the top of the bottom plate to provide further reinforcement. Another option is to have the base plate 13 sit over the bottom plate 16 in which case the upper horizontal arm of the base plate may have a downwardly extending lip, for example, as shown in FIG. 13.

Figure 8:
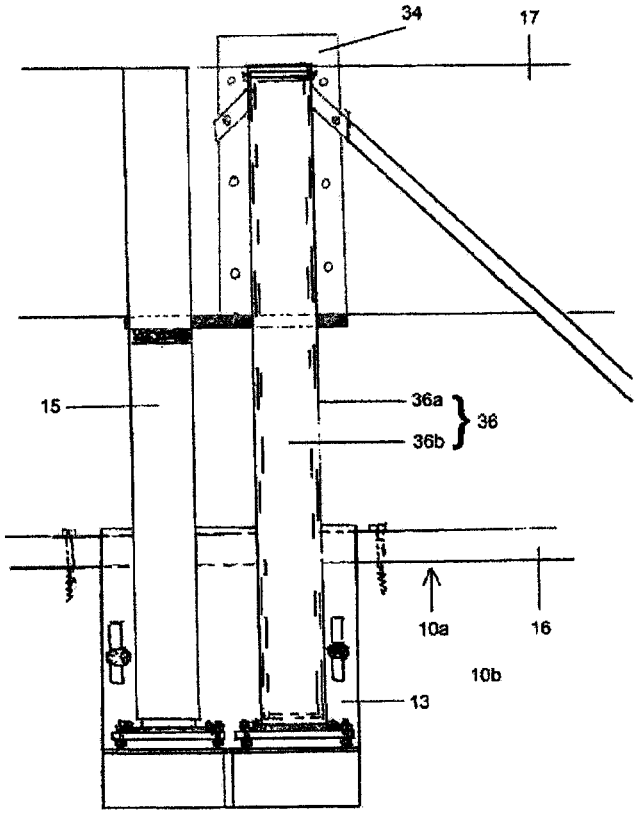
FIG. 8 is a front view of the second embodiment of the lifting device and the second embodiment of the support means.
Figure 9:
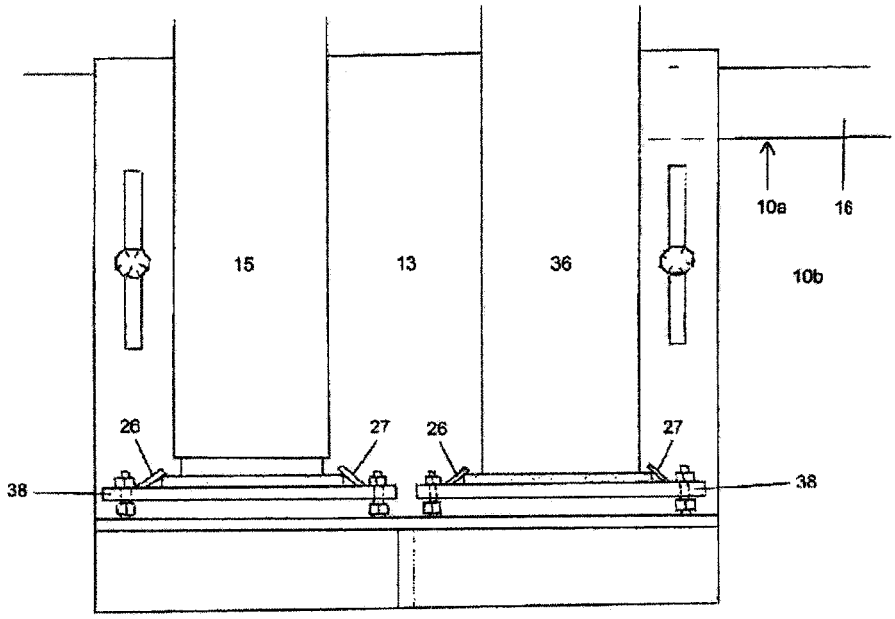
FIG. 9 is a close-up, front view of the base of the second embodiment of the lifting device and the base of the second embodiment of the support means.
Figure 10:
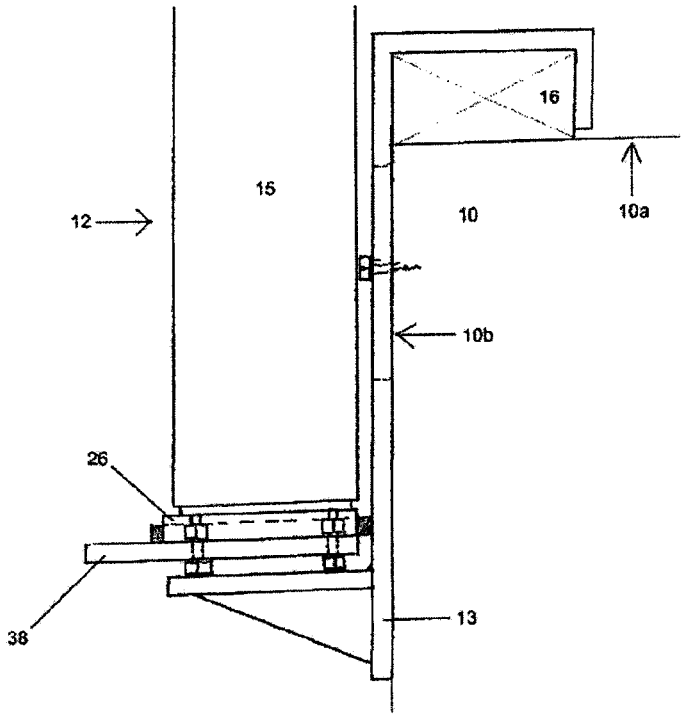
FIG. 10 is a close-up, side view of the base of the second embodiment of the lifting device.

In this embodiment, the support means 28 is an extendable prop. As shown best in FIGS. 7 and 11, the prop comprises a load receiving platform 35 extending substantially perpendicularly from a metal cover 34, two or more elongate elements (36*a*, 36*b*, 36*c*, etc.) capable of telescoping relative to each other, and one or more locking mechanisms 37 to prevent retraction of an elongate element. The extendable prop may be made of metal or of timber. As shown in FIGS. 8 and 9, the prop is mounted to the same base plate 13 as the lifting device 12. However, the prop could have its own base plate. Once levelled, the prop is braced back onto the fixed base plate 16.

As shown best in FIG. 9, the jack 15 and the extendable prop 36 are adjustably mounted to the lower horizontal arm of the base plate 13 such that the positions of the jack and the prop are vertically and horizontally adjustable relative to the base plate. To allow vertical movement, the jack and prop are each connected to a vertically adjustable plate 38 having four apertures for engagement with four pins fixed to the base plate such that the position of the vertically adjustable plate can be raised or lowered on the pins. To allow horizontal movement, the jack and prop are each slidably mounted to the vertically adjustable plate by virtue of a linear-motion slide assembly comprising a pair of spaced apart runners 26 and 27 connected to the vertically adjustable plate. The two runners in each pair are inclined towards each other so as to slidably engage with either the jack or the prop. Due to the height restriction caused by a pitched roof 11, the vertically adjustable plates may need to be rotated so that the runners are correctly orientated in accordance with the intended direction of travel of the jack and the prop.

Figure 13:
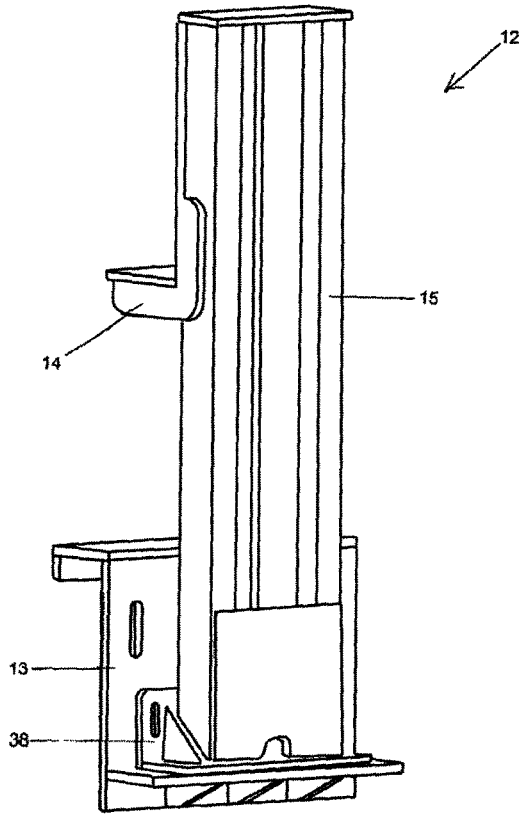
FIG. 13 is a perspective view of a third embodiment of a lifting device.
Figure 14:
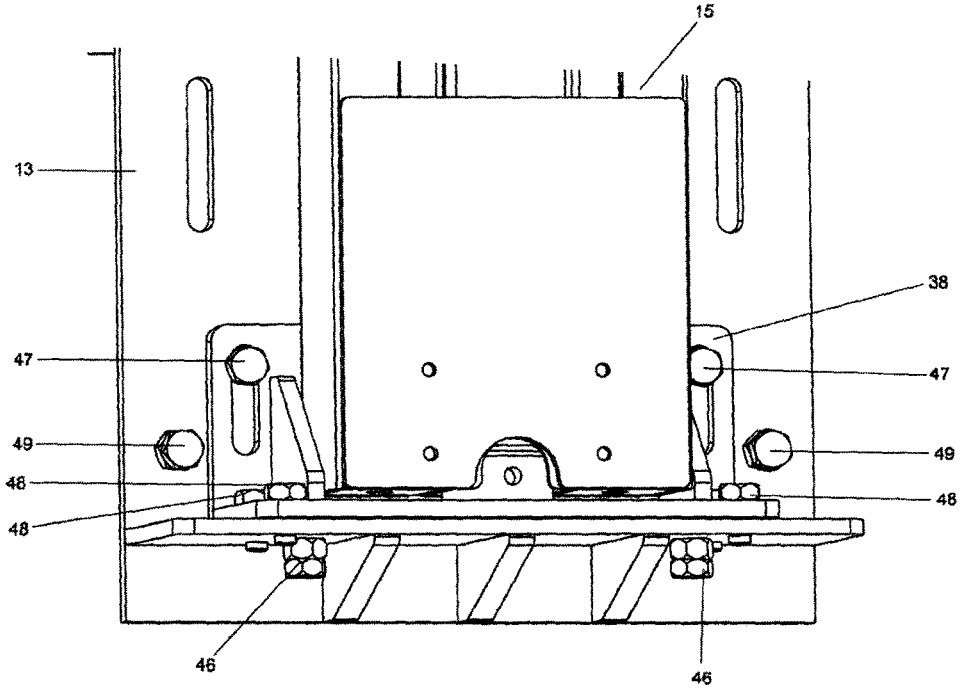
FIG. 14 is a close-up, front view of the base of the third embodiment of the lifting device.

FIGS. 13 and 14 illustrate an alternative embodiment of the lifting device 12. As best shown in FIG. 14, the base of the lifting device contains a generally L-shaped vertically adjustable plate 38 to which the jack 15 is permanently fixed. The vertically adjustable plate is adjustably mounted by threaded bolts 46 to the lower horizontal arm of the generally Z-shaped base plate 13 such that the position of the jack is vertically adjustable relative to the base plate to ensure a plumb lift. Once plumbed, locking bolts 47 within slots in the vertically adjustable plate can be tightened. Locking bolts 48 extending from the vertically adjustable plate to the lower horizontal arm of the base plate can also be tightened. The base plate itself has adjustable bolts 49 so as to plumb the base plate relative to the side face 10*b* of the floor surface 10. Although FIG. 14 shows the base of the lifting device, it will be appreciated that an identical arrangement can also be used to support the base of a prop.

Figure 11:
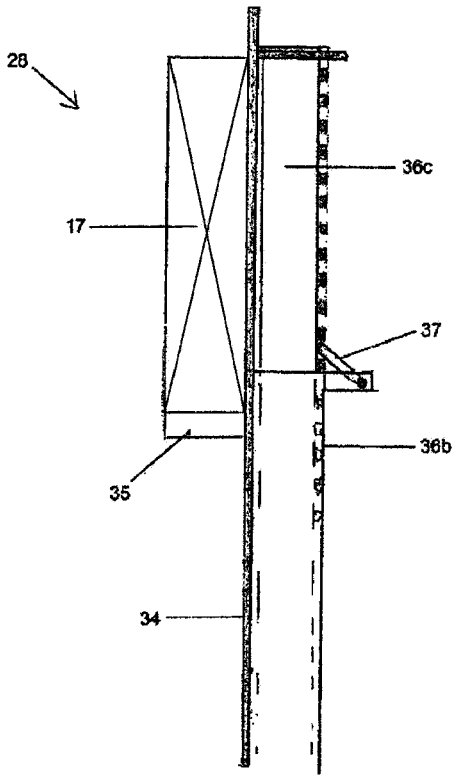
FIG. 11 is a close-up, side view of the top of the second embodiment of the support means with a telescopic element having been extended.

The lifting platform 14 of the lifting device 12 and the load receiving platform 35 of the support means 28 can be connected together, for example, by a metal rod (not shown), to ensure that the two platforms are simultaneously lifted by the jack 15. As shown in FIG. 11, the cover 34 with the load receiving platform of the support means can be connected to the free end of a telescopic element 36*c* of the prop. A biased locking mechanism 37 permits the telescopic element to be extended but prevents it from being retracted.

A plurality of lifting devices 12 are preferably used to lift the roof 11, each device being spaced apart around the perimeter of the floor surface 10. The first stage of the lift is for the lifting platform 14 of each lifting device to lift the top plate 17, and consequently the connected roof, to the top of the jacks 15.

During the lift, the roof 11 is supported by a plurality of the support means 28, each support means being paired with a lifting device 12 around the perimeter of the floor surface 10. In the event that the jacks 15 fail, the support means will prevent the roof from falling to the floor surface. Additionally or alternatively, the jacks themselves could have a safety mechanism built in to prevent the roof from falling to the floor surface.

With the lifted roof 11 supported in a first elevated position by the support means 28, if necessary for further extension, an extension portion 32 with a second lifting platform 33 can be fitted to the top of each jack 15 as shown in FIG. 3. The extension portions allow the jacks to lift the roof to a second elevated position which is higher than the first elevated position if required.

Figure 12:
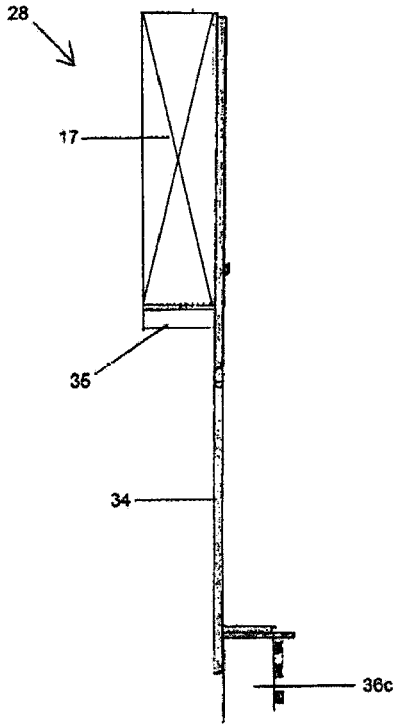
FIG. 12 is a close-up, side view of the cover plate shown in FIG. 11 attached to the free end of the extended telescopic element.

With the weight of the lifted roof 11 held by the lifting platforms 33 on the extension portions 32 of the jacks 15, a locking pin (not shown) can be inserted into each jack to prevent movement of the lifting platforms. If necessary, the telescopic elements of the props 36 can then be lowered and the covers 34 rotated and bolted higher on the telescopic elements as shown in FIG. 12. The locking pins are removed from the jacks and the roof lifted to the second elevated position by means of the second lifting platforms 33. Once the roof is in the second elevated position, the locking pins can be inserted back into the jacks for safety.

With the lifted roof 11 supported in the second elevated position by the support means 28, further construction work can be carried out. Such work may comprise constructing or inserting a plurality of side walls within the space between the floor surface 10 and the underside of the roof, for example, putting premade frames in place.

Figure 15:
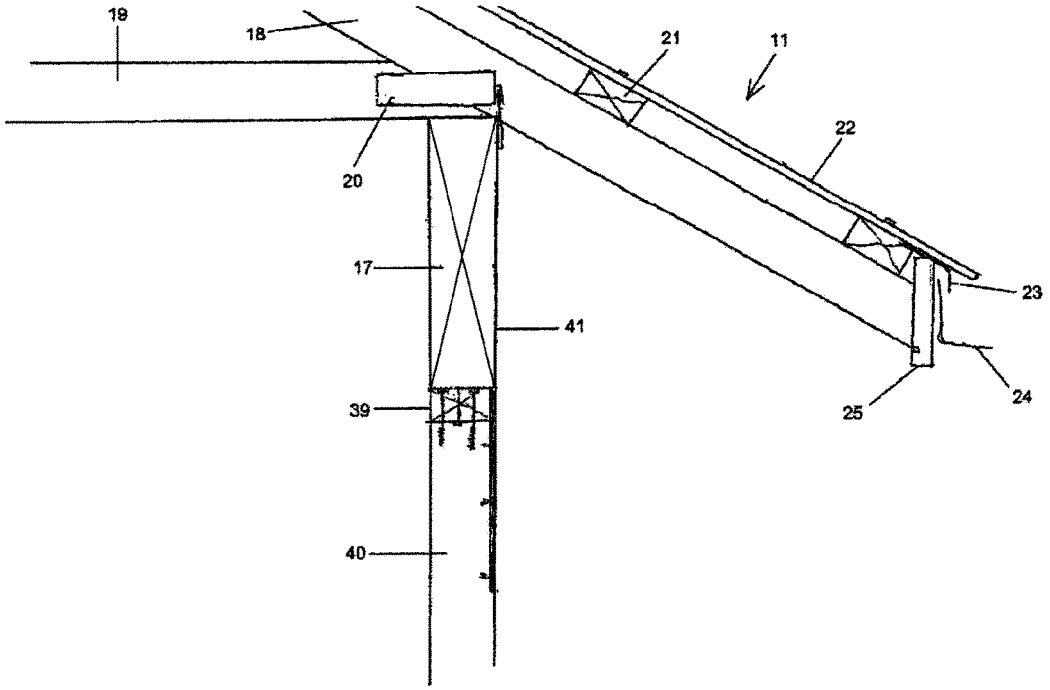
FIG. 15 is a side view of a roof secured to a wall stud by a strap.
Figure 16:
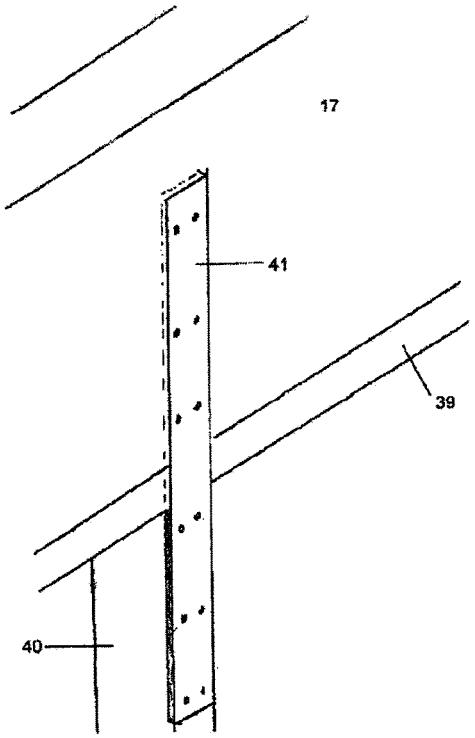
FIG. 16 is a close-up, perspective view of the strap in FIG. 15.

As shown in the embodiment shown in FIGS. 15 and 16, the top plate 17 made of LVL or other suitably strong material can be secured by screws to a second top plate 39 made of ordinary timber attached to a premade frame 40. If needed for stiffness, a steel strap 41 can be screwed to the double top plates to provide reinforcement.

Figure 17:
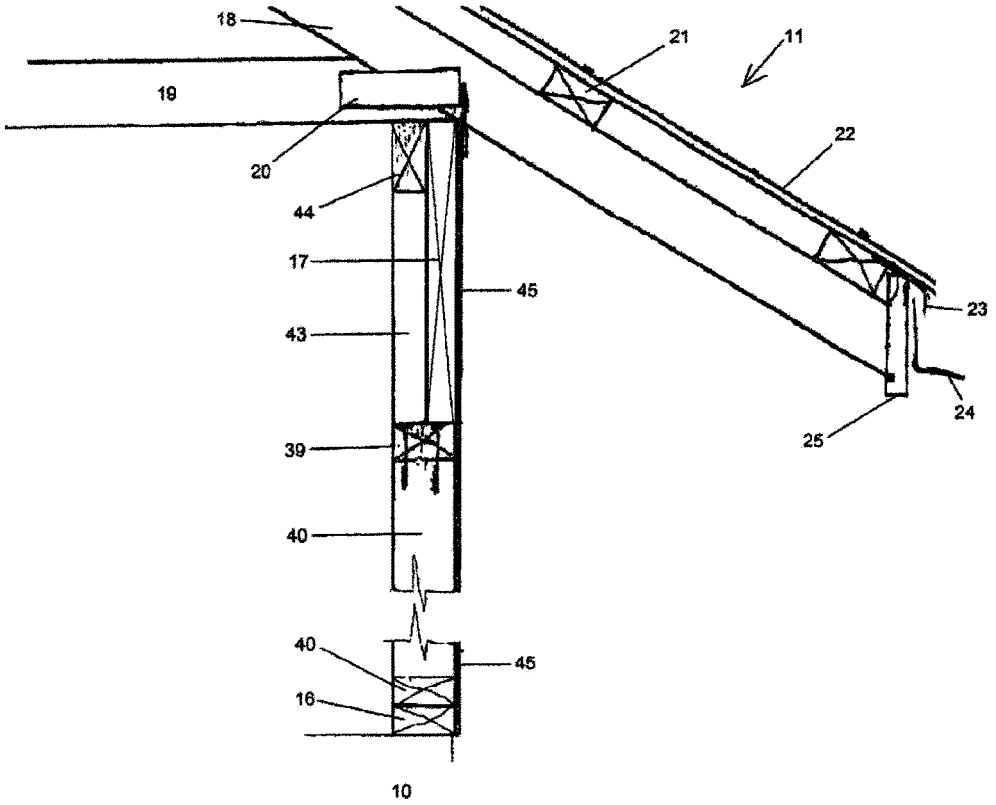
FIG. 17 is a side view of a roof secured to a wall stud by a plywood barrier.
Figure 18:
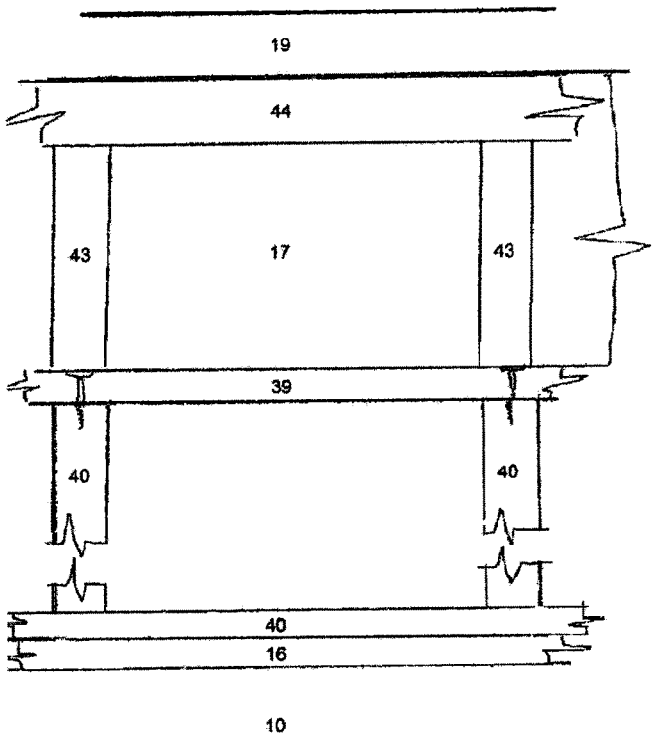
FIG. 18 is a side view of the building in FIG. 17.

LVL is more expensive than conventional timber. FIGS. 17 and 18 therefore show an alternative embodiment in which the depth of the LVL top plate 17 remains approximately 400 cm but the width has been halved from approximately 90 cm to approximately 45 cm. As shown in FIGS. 17 and 18, the narrower top plate is supplemented by a plurality of spaced apart jack studs 43 (approximately 45 cm×45 cm) and by a top ribbon board 44 (approximately 90 cm×45 cm). As shown in FIG. 17, once the frames 40 are in place, a plywood barrier 45 (e.g. Ecoply® produced by Carter Holt Harvey Limited) can be fixed to the exterior walls to provide waterproofing. The plywood barrier eliminates the need to use stud to top plate fixing, lintel strap fixings, bottom plate strap fixings or building paper. It also has the advantages of being robust, airtight and vermin proof.

Figure 19:
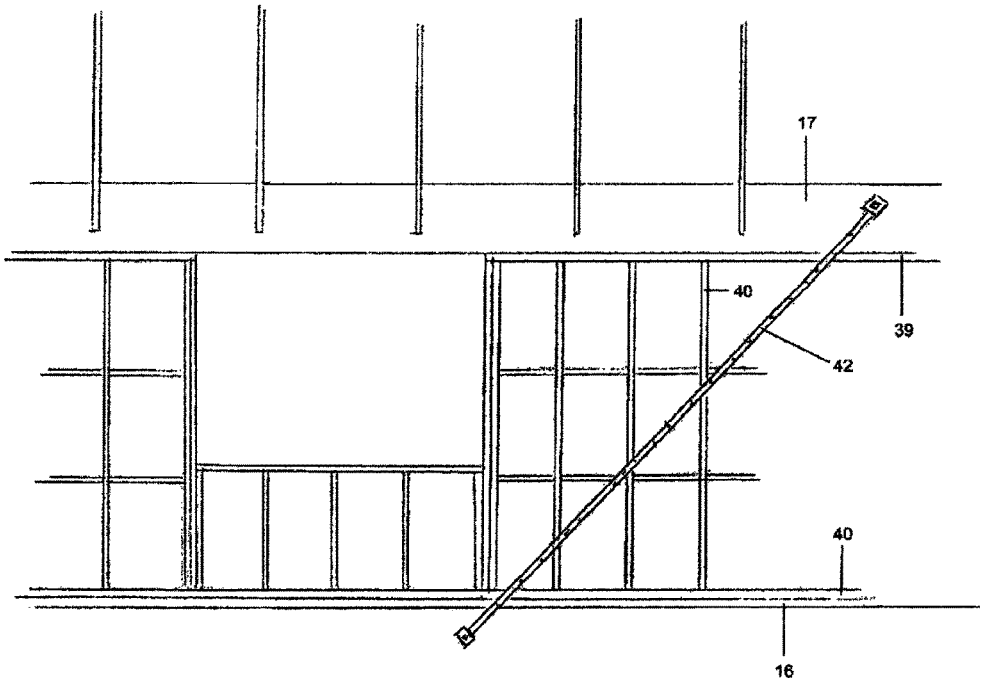
FIG. 19 is a front view of an extendable brace, in use, attached to the floor surface and the top plate.
Figure 20:
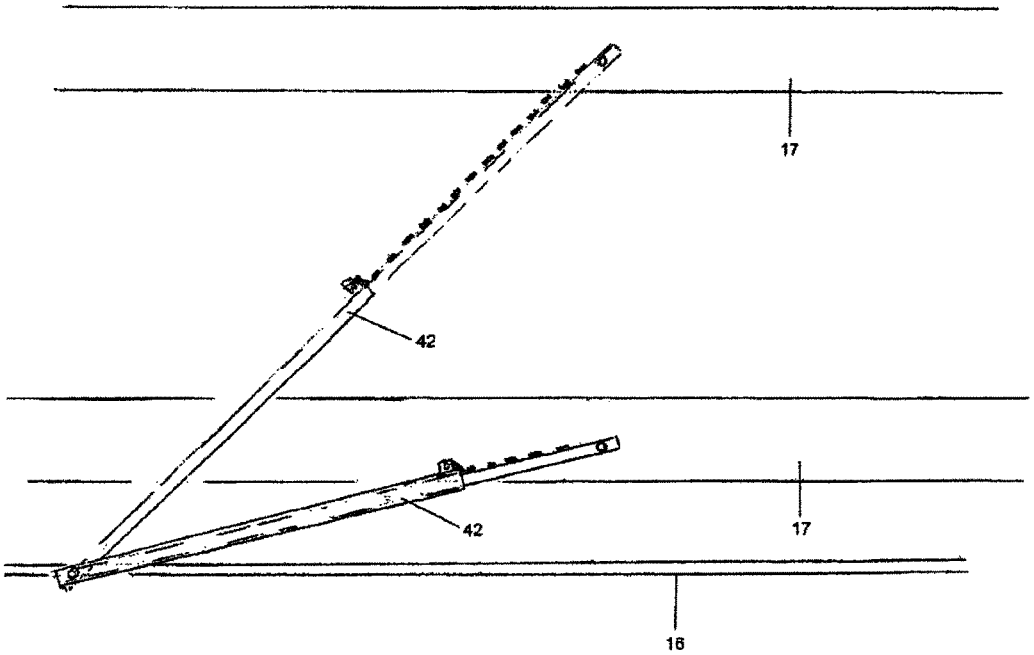
FIG. 20 is front view of the extendable brace showing the change in the extension of a telescopic element of the brace as the roof is lifted.

As shown in FIGS. 19 and 20, to provide stability against sideways movement, an extendable brace 42 having a telescopic element can be attached to the floor surface and the top plate. As depicted in FIG. 20, the brace can be attached before the roof 11 is lifted and extend as the roof is lifted. A locking mechanism permits the telescopic element to be extended but prevents it from being retracted.

The building construction method described herein provides a number of significant advantages over prior art methods of construction; including: a safer environment for workers; no scaffolding or edge protection necessary; no safety netting or fall protection needed for work above the top plate; roof trusses can be fixed with no need for cranes; the constructed building complies with the NZS 3604 building code for timber-framed buildings (although the method of construction is different from known methods); council roof inspections can be done at ground level; the building site is under cover quicker; no delays caused by weather; and if the lift of the roof is plumb, there is no need to plumb the exterior walls.

Another significant advantage is that the construction and roofing labour costs will be reduced since: all work is done without the inconvenience of scaffolding in the way; the LVL top plate acts as lintels for all window and door openings; wall framing does not require lintel jack studs, trimming studs or individual lintels; no dwangs/nogs/noggings in the wall framing for the soffit; the frames are lighter (no top heavy lintels); no need for a ceiling batten on the top plate; fewer people are needed to pass up roofing materials; and roof trusses can be handled at ground level. Future alterations to window or door openings can be made anywhere in the exterior walls as the lintels (top plate) are already in place.

While some preferred aspects of the invention have been described by way of example, it should be appreciated that modifications and/or improvements can occur without departing from the scope of the invention as claimed in this specification. For example, it will be appreciated that a two or more storey building could be built using the same method described herein, for example, by lifting both the roof and the first storey of the building together and fitting the ground floor frames in the space between the floor surface and the lifted first storey and roof of the building.

The terms comprise, comprises, comprising, or comprised, if and when used herein, should be interpreted non-exclusively, that is, as conveying "consisting of or including".

What is claimed is:

1. A lifting device for lifting an upper portion of a building comprising a roof and an underside, the building further comprising a support having an edge region comprising a substantially horizontal upper face and a substantially vertical side face, the lifting device comprising:

a base plate configured to be mounted to the edge region of the support, the base plate having a generally Z-shaped cross-sectional configuration comprising an upper horizontal portion configured to abut the substantially horizontal upper face of the support, a vertical middle portion configured to abut the substantially vertical side face of the support, and a lower horizontal portion configured to support an actuator;

a lifting platform configured to abut and lift the upper portion of the building such that a lower portion of the building may be constructed or inserted within a space between the support and the underside of the upper portion of the building; and an actuator movably coupled along a length of the actuator to the lifting platform and configured to vertically move the lifting platform, the actuator fixed to a vertically adjustable plate which is adjustably mounted to the lower horizontal portion of the base plate such that the actuator is configured to be adjusted vertically relative to the base plate to ensure a plumb lift, the actuator further configured to be adjusted horizontally relative to the base plate.

2. The lifting device according to claim 1, wherein the upper horizontal portion has a downwardly extending lip.

3. The lifting device according to claim 1, wherein the base plate has a generally T-shaped cross-sectional configuration comprising two horizontal portions and an intersecting vertical portion.

4. The lifting device according to claim 1, wherein the actuator is slidably mounted to the base plate by virtue of a linear-motion slide assembly comprising a pair of spaced apart runners connected to either the base plate or to a vertically adjustable plate attached to the base plate.

5. The lifting device according to claim 1, wherein the lifting device includes a support means for supporting an upper portion of a building in an elevated position, the support means being arranged in such a manner that the upper portion cannot fall to a floor surface in the event of the failure of the lifting device.

6. The lifting device according to claim 5, wherein the support means comprises a load receiving platform capable of vertical movement, an extendable prop comprising two or more elongate elements capable of telescoping relative to each other, and one or more locking mechanisms to prevent retraction of an elongate element.

7. The lifting device according to claim 6, wherein the extendable prop is adjustably mounted to the base plate such that the position of the prop is horizontally and/or vertically adjustable relative to the base plate.

8. The lifting device according to claim 1, wherein the actuator is a hydraulic actuator.

9. The lifting device according to claim 8, wherein the actuator is a hydraulic jack or hydraulic ram.

10. A method of constructing a building comprising the steps of preparing a floor surface, constructing an upper portion of a building which comprises a roof, lifting the upper portion of the building to an elevated position above the floor surface using one or more lifting devices according to claim 1 so as to create a space between the floor surface and the underside of the upper portion of the building, and supporting the upper portion of the building in the elevated position for further construction work.

11. The method according to claim 10, wherein the upper portion of the building is constructed on a plurality of spaced apart spacer elements on the floor surface and lifted from an initial position on the spacer elements to the elevated position.

12. The method according to claim 10, including the steps of fixing a bottom plate around the perimeter of the floor surface and fixing a top plate around the underside of the upper portion of the building.

13. The method according to claim 10, wherein the one or more lifting devices are mounted to the floor surface.

14. The method according to claim 10, wherein there is a plurality of the lifting devices, each lifting device being spaced apart around an edge along the perimeter of the floor surface and mounted to the edge by the base plate.

15. The method according to claim 10, wherein the upper portion of the building is supported during the lift, and in the elevated position, by one or more support means in such a manner that the upper portion cannot fall to the floor surface in the event of the failure or removal of the one or more lifting devices.

16. The method according to claim 10, wherein the one or more lifting devices each have a safety mechanism to prevent the upper portion of the building from falling to the floor surface.

17. The method according to claim 10, wherein the upper portion of the building is lifted to a first elevated position by the one or more lifting devices and supported in the first elevated position by one or more support means, the one or more lifting devices is then fitted with an extension portion configured to lift the upper portion of the building to a second elevated position which is higher than the first elevated position.

18. The method according to claim 17, wherein the one or more lifting devices lifts the upper portion of the building from the first elevated position to the second elevated position.

19. The method according to claim 10, wherein the upper portion of the building consists of a roof.

20. The method according to claim 10, wherein the upper portion of the building consists of a roof and one or more stories of the building.

21. The method according to claim 10, wherein the further construction work comprises constructing or inserting a lower portion of the building within the space between the floor surface and the underside of the upper portion of the building.

22. The method according to claim 21, wherein the lower portion of the building comprises one or more stories of the building.

* * * * *